US008281750B2

(12) United States Patent
Kim

(10) Patent No.: US 8,281,750 B2
(45) Date of Patent: Oct. 9, 2012

(54) BOILER FURNACE TO AVOID THERMAL NOX

(76) Inventor: Byung-Doo Kim, Seoul (KR)

( * ) Notice: Subject to any disclaimer, the term of this patent is extended or adjusted under 35 U.S.C. 154(b) by 638 days.

(21) Appl. No.: 12/432,006

(22) Filed: Apr. 29, 2009

(65) Prior Publication Data

US 2009/0260582 A1 Oct. 22, 2009

Related U.S. Application Data

(63) Continuation-in-part of application No. 11/681,785, filed on Mar. 4, 2007.

(51) Int. Cl.
*F22B 25/00* (2006.01)

(52) U.S. Cl. ..... 122/6 A; 122/235.12; 122/235.28; 122/249

(58) Field of Classification Search ..... 122/1 B, 122/6 A, 11, 12, 84, 85, 116, 235.23, 235.28, 122/249, 251, 252, 235.12, 240.3
See application file for complete search history.

(56) References Cited

U.S. PATENT DOCUMENTS

| | | | | |
|---|---|---|---|---|
| 2,748,754 | A * | 6/1956 | Lotz | 122/235.28 |
| 2,793,626 | A * | 5/1957 | Hubel | 122/235.28 |
| 2,796,051 | A | 6/1957 | Throckmorton et al. | |
| 2,914,386 | A | 11/1959 | Shapleigh | |
| 3,855,071 | A | 12/1974 | Koppelman | |
| 4,615,715 | A | 10/1986 | Seshamani | |
| 4,672,900 | A * | 6/1987 | Santalla et al. | 110/264 |
| 4,721,454 | A * | 1/1988 | Schirmer et al. | 431/10 |
| 4,746,337 | A * | 5/1988 | Magol et al. | 55/434.1 |
| 4,825,813 | A | 5/1989 | Yoshinari et al. | |
| 4,879,959 | A | 11/1989 | Korenberg | |
| 4,900,246 | A * | 2/1990 | Schirmer et al. | 431/352 |
| 4,909,191 | A | 3/1990 | Le Mer | |
| 4,951,612 | A | 8/1990 | Gorzegno | |
| 5,123,361 | A | 6/1992 | Nieh et al. | |
| 5,226,936 | A * | 7/1993 | Garkawe | 55/434.4 |
| 5,242,294 | A | 9/1993 | Chato | |
| 5,273,209 | A | 12/1993 | MacArthur et al. | |
| 5,315,939 | A | 5/1994 | Rini et al. | |
| 5,791,299 | A | 8/1998 | Matsuo et al. | |
| 6,116,196 | A * | 9/2000 | Watanabe et al. | 122/235.11 |
| 6,269,782 | B1 | 8/2001 | Kayahara et al. | |
| 6,318,305 | B1 * | 11/2001 | Takubo et al. | 122/235.11 |
| 7,168,949 | B2 | 1/2007 | Zinn et al. | |
| 2003/0013059 | A1 | 1/2003 | Dutescu et al. | |
| 2007/0275335 | A1 | 11/2007 | Biscan et al. | |

FOREIGN PATENT DOCUMENTS

| | | |
|---|---|---|
| CN | 86101227 | 9/1986 |
| CN | 1272605 | 11/2000 |
| EP | 0786624 | 11/2000 |
| JP | 62178802 | 8/1987 |

(Continued)

OTHER PUBLICATIONS

SIPO Examination Report, dated Aug. 29, 2008.

(Continued)

*Primary Examiner* — Gregory A Wilson
(74) *Attorney, Agent, or Firm* — McNeely, Hare & War LLP; Kevin J. McNeely

(57) ABSTRACT

A boiler furnace avoids NOx and increases thermal efficiency with a small boiler. The boiler furnace has an outer water wall and an inner water wall with flared top and bottom portions.

18 Claims, 14 Drawing Sheets

FOREIGN PATENT DOCUMENTS

| | | |
|---|---|---|
| JP | 02-075805 | 3/1990 |
| KR | 1981-0002258 | 2/1981 |
| KR | 2001-0021146 | 3/2001 |
| KR | 10-2002-0039130 | 5/2002 |
| SU | 909475 | 2/2002 |

OTHER PUBLICATIONS

Office Action issued by the Korean Intellectual Property Office for the corresponding Korean application 10-2004-0071483; Mar. 29, 2006.

Decision to Grant issued by the Korean Intellectual Property Office for the corresponding Korean application 10-2004-0071483; Sep. 10, 2007.

Office Action issued by the Russian Federal Institute for Industrial Property for the corresponding Russian application 2007104686/06(005047); Jun. 20, 2008.

* cited by examiner

[FIG. 5]

BOILER FURNACE TO AVOID THERMAL NOX

CROSS-REFERENCE TO RELATED APPLICATIONS

This continuation-in-part application claims priority to Korean patent application 10-2004-0071483 filed on Sep. 7, 2004, international patent application PCT/KR2005/002957 filed on Sep. 7, 2005, and U.S. patent application Ser. No. 11/681,785 filed on Mar. 4, 2007, which are incorporated herein by reference.

TECHNICAL FIELD

The present invention relates to a boiler furnace.

BACKGROUND

Conventional boiler furnaces for making electricity have water walls composed of tubes to contain water and members to connect the tubes. The furnace has a rectangular shape composed of four water walls. The water walls are composed of boiler tubes and connecting members. Each corner has a fuel/air nozzle that injects the mixture of fuel and air into the furnace. For a pulverized coal boiler, the nozzle injects fuel and air at a tangential direction to the assumed position of the fire in the furnace. Some boilers employ a super-heating zone above the furnace to absorb the heat and prevent it from going up the chimney. However, the intense fire makes thermal NOx due to a temperature that can exceed 1,000° C. The higher the firing temperature, the more thermal NOx is produced.

SUMMARY

In one general aspect, a boiler furnace includes an outer water wall and an inner water wall positioned inside the outer water wall to define a combustion space between the outer water wall and the inner water wall. The inner water wall comprises a circular cross section with a middle portion having a narrower diameter and top and bottom portions having a wider diameter.

Implementations may include one or more of the following features. For example, the outer water wall may have a circular shape. The outer water wall may also have a cross section that slopes inward so that a top of the outer water wall has a smaller diameter than a bottom of the outer water wall.

The outer water wall may include a first set of water pipes in, for example, a helical arrangement. The inner water wall may include a second set of water pipes also in a helical arrangement. The second set of water pipes may have air gaps between each of the water pipes.

In another implementation, the inner water wall defines a trumpet-like shape. Additionally, the inner water wall and the outer water wall may be in a coaxial arrangement.

A plurality of fuel nozzles may be installed on the outer water wall to provide a fuel spray pattern tangential to surfaces of the inner water wall.

A furnace wall may surround the outer water wall and a thermal insulator may be positioned between the furnace wall and the outer water wall.

As another feature, an inner water supply header may be installed at a bottom of the inner water wall and an inner steam receiving header may be positioned at a top of the inner water wall. In addition, an outer water supply header may be installed at a bottom of the outer water wall and an outer steam receiving header may be positioned at a top of the outer water wall.

In still another general aspect, a boiler furnace includes an outer water wall, an inner water wall positioned inside the outer water wall to define a combustion space between the outer water wall and the inner water wall, a furnace wall surrounding the outer water wall, and a thermal insulator positioned between the furnace wall and the outer water wall. The inner water wall includes a circular cross section with a flared top portion having a wider diameter at the top portion. Implementations may include any of the above or following features.

In still a further general aspect, a method of operating a boiler furnace that includes an inner water wall with flared top and bottom portions surrounded by an outer water wall to define a combustion chamber between the inner and outer water walls, includes the following operations: spraying fuel from the outer wall into the combustion chamber; injecting an airflow through the inner wall into the combustion chamber; igniting the air-fuel mixture in the combustion chamber; monitoring the flame profile in the combustion chamber; and adjusting the injected airflow or sprayed fuel into the combustion chamber to cause a flame in an annular or ring-like shape around the curved inner water wall and surrounded by the outer water wall. Implementations may include any of the above features.

The present invention has been made in an effort to avoid or minimize thermal NOx emissions and to stabilize a flame profile in a boiler furnace. Another object of the present invention is to provide a smaller boiler with high thermal efficiency. The boiler furnace according to the present invention includes outer water walls and spray nozzle to inject fuel and air at each corner. Supplemental water walls are placed in the space surrounded by outer water walls and are located in the assumed fire ball location. The small space surrounded by supplemental water walls can be utilized as a useful space, like as pre-heater, economizer. Therefore, the boiler furnace of the present invention avoids an intense fire ball and makes a lower flame temperature thereby reducing or avoiding production of thermal NOx and providing more heat transferring to water due to a larger contact surface which can lead to small boiler with higher efficiency. The flames in the furnace are surrounded by outer water walls and are reflected by inner water walls to heat the water in the outer water walls. By reflecting the heat between the walls, the thermal energy of the flame is also transferred to the water in the inner water walls. More heat is transferred to the water walls by shortening the distance from the flame to the outer water walls and by the additional heating of the inner water walls. Thermal NOx is reduced by a fire with a lower flame temperature even though it has maximum combustion efficiency.

DETAILED DESCRIPTION OF THE INVENTION

The objects to be achieved and the technical problems to be overcome can be solved by the present invention. Eddy blowing nozzles installed at each corner of the furnace spray a fuel-air mixture in a wide pattern near the outer water walls. A flame reflecting structure composed of heat resistant material or a heat resistant water with air holes to inject cooling air protects the inner water walls from the flame are installed at a distance which provides the highest temperature of the reflected flame on the surface of outer water walls. The space between the outer water walls and the inner reflecting structure become a combustion chamber into which fuel and air is injected and makes a fire tunnel which has high temperature and a high density flame and increases the heat transfer to the water walls. The injection angle of the fuel-air mixture from eddy nozzle is tilted from the horizontal to provide tangential access to the center of the flame. The vertical height of the injected fuel-air mixture from the eddy nozzle can be adjusted to control the temperature in the furnace. Cooling air holes of the inner water wall are arranged in a helical distribution with an upward angle causing a spiral-shaped flame motion along the surface of the inner water walls and to pass the super heater zone, economizer, preheater and chimney located above the boiler furnace.

Figure 1A:
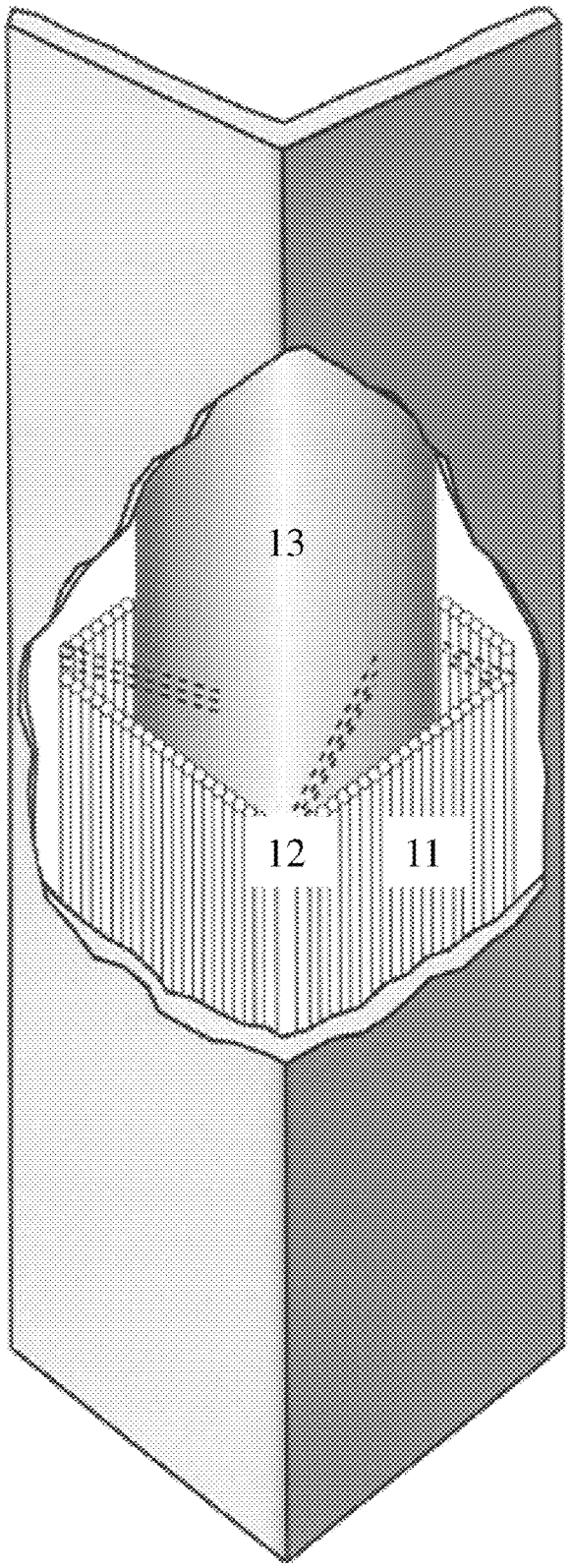
FIGS. 1A, 1B and 1C are a perspective view with a cut-out portion illustrating one of a conventional pulverized coal boiler furnace; a top view of the conventional boiler furnace; and a fireball generated in the conventional boiler furnace, respectively.
Figure 1B:
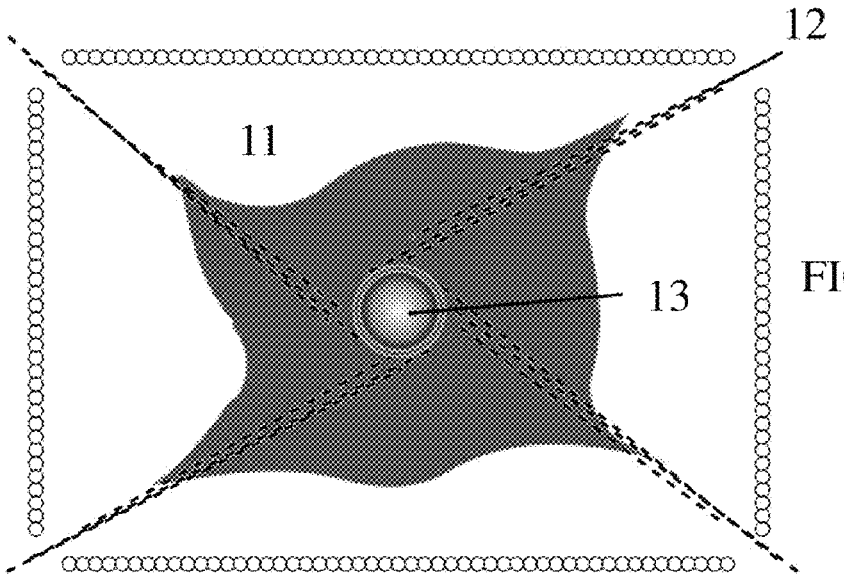
Figure 1C:
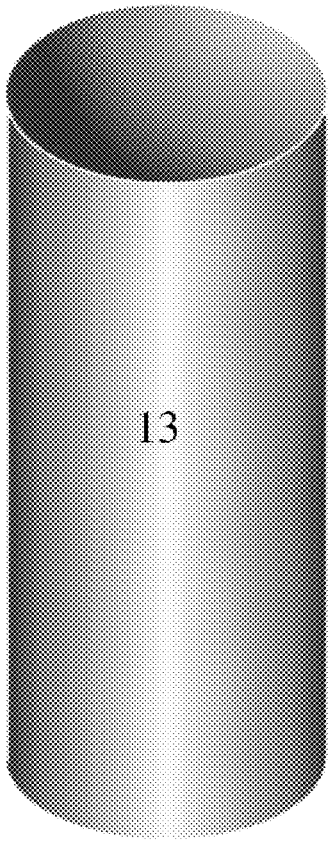
Figure 2A:
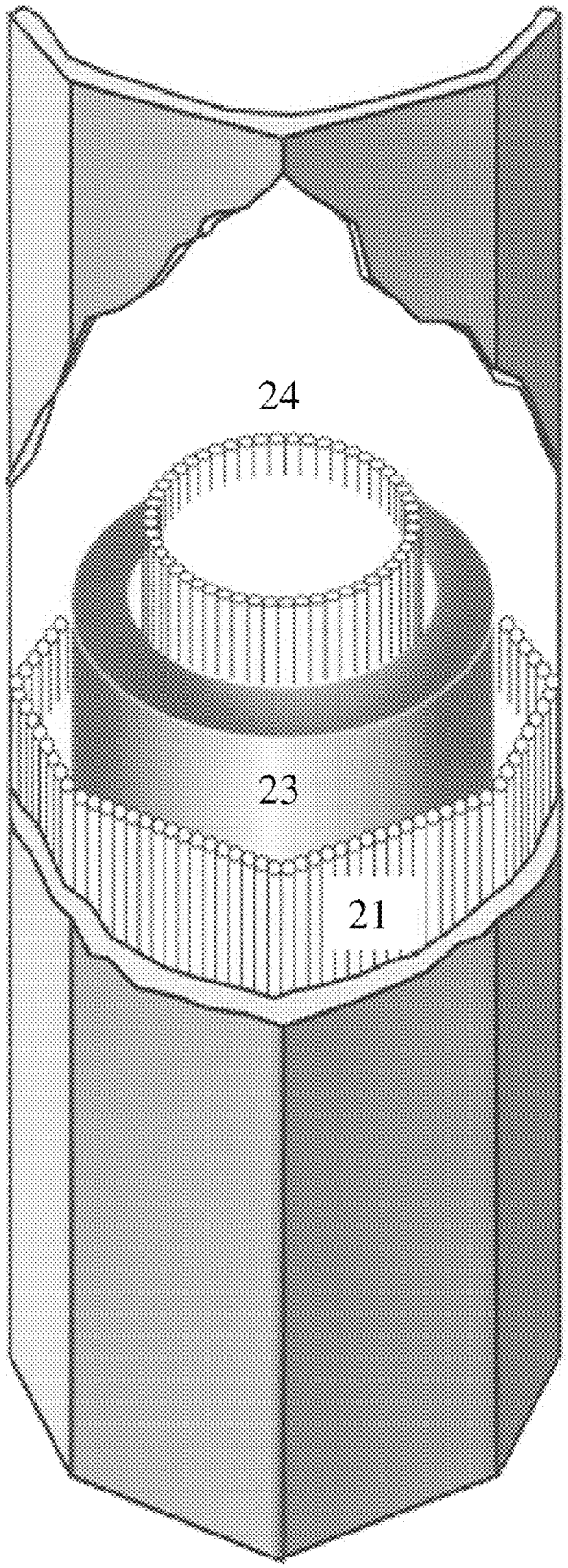
FIGS. 2A, 2B and 2C are a perspective view illustrating a first embodiment of the present invention; is a top view of the embodiment; and a fireball generated in the embodiment of FIG. 2A, respectively.
Figure 2B:
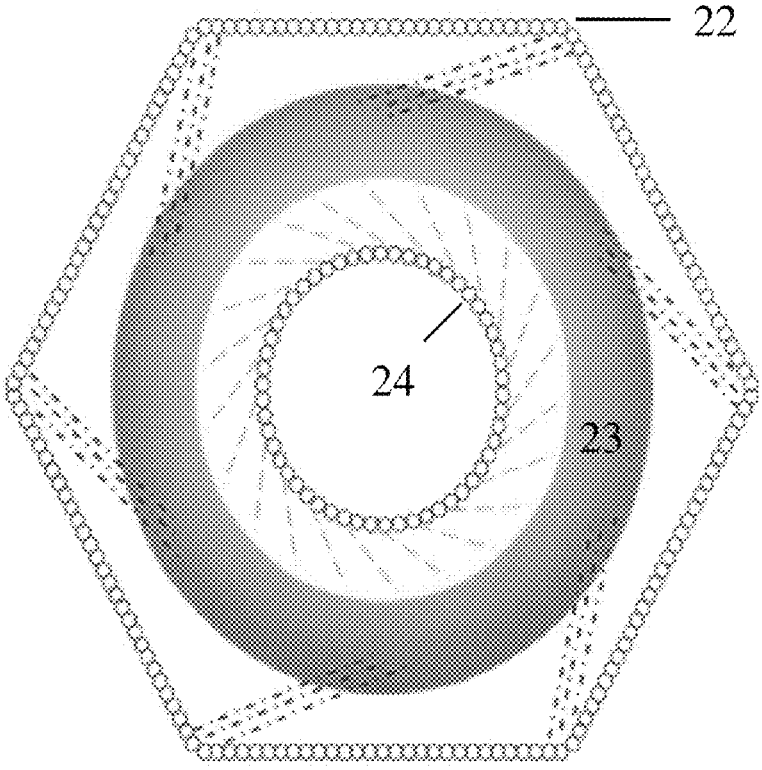
Figure 2C:
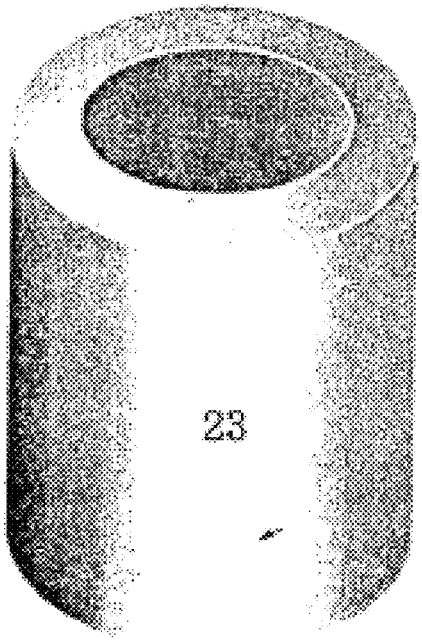
Figure 11:
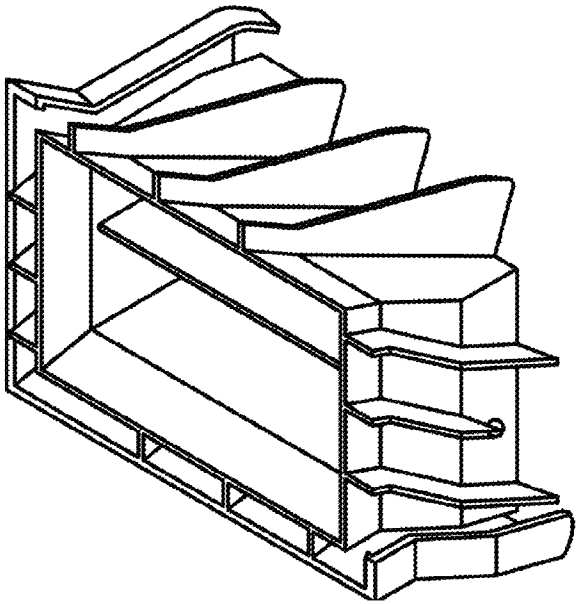
FIG. 11 is a perspective view of an eddy fuel-air spray nozzle tip.
Figure 12:
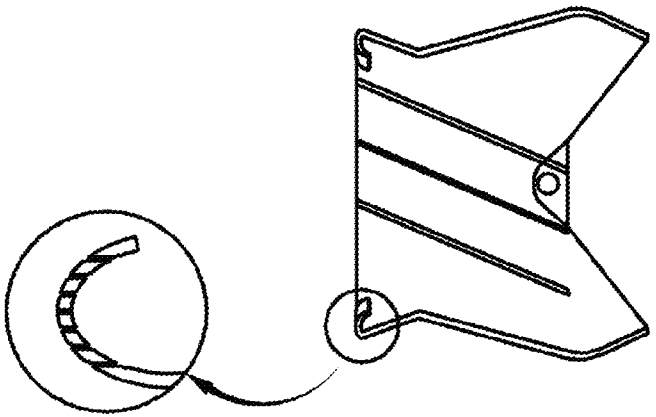
FIG. 12 is a cross-sectional view of the eddy fuel-air spray nozzle tip.

The present invention is explained in more detail in the illustrated examples. FIGS. 1A, 1B and 1C are views illustrating a conventional boiler which includes an outer water wall (11), a fuel-air nozzle tip (12) and a fire ball (13). While the flame pattern tends to follow the fuel spray pattern, the hottest location is the fire ball 13 shown as a cylindrical shape in FIG. 1*c*. As shown in FIGS. 2A, 2B and 2C, the boiler of the present invention is composed of water walls (21) (referred to as outer water walls) at the outer boundary and an eddy fuel-air injection nozzle tip (22) at each corner and cylindrical flame reflecting water walls (24) (referred to as inner water walls) in the center of the combustion room. A more detailed view of the eddy fuel-air nozzle is shown in FIG. 11 and FIG. 12.

Figure 3:
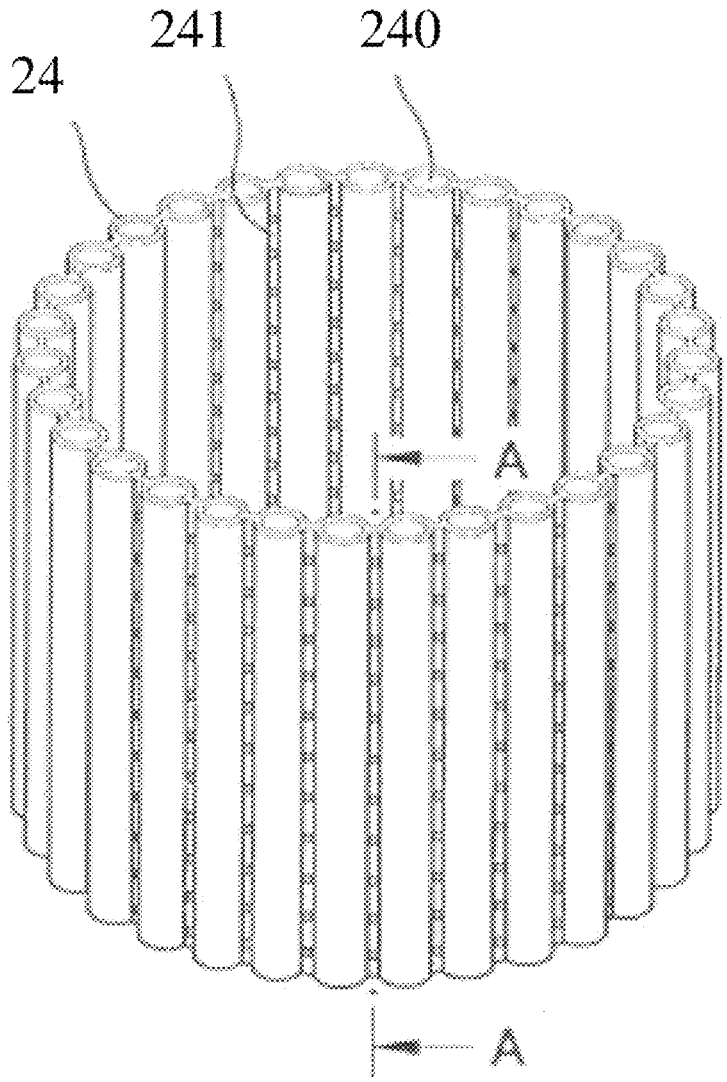
FIG. 3 is a sectional view illustrating vertical arrangement of inner water walls and cooling air holes.
Figure 4:
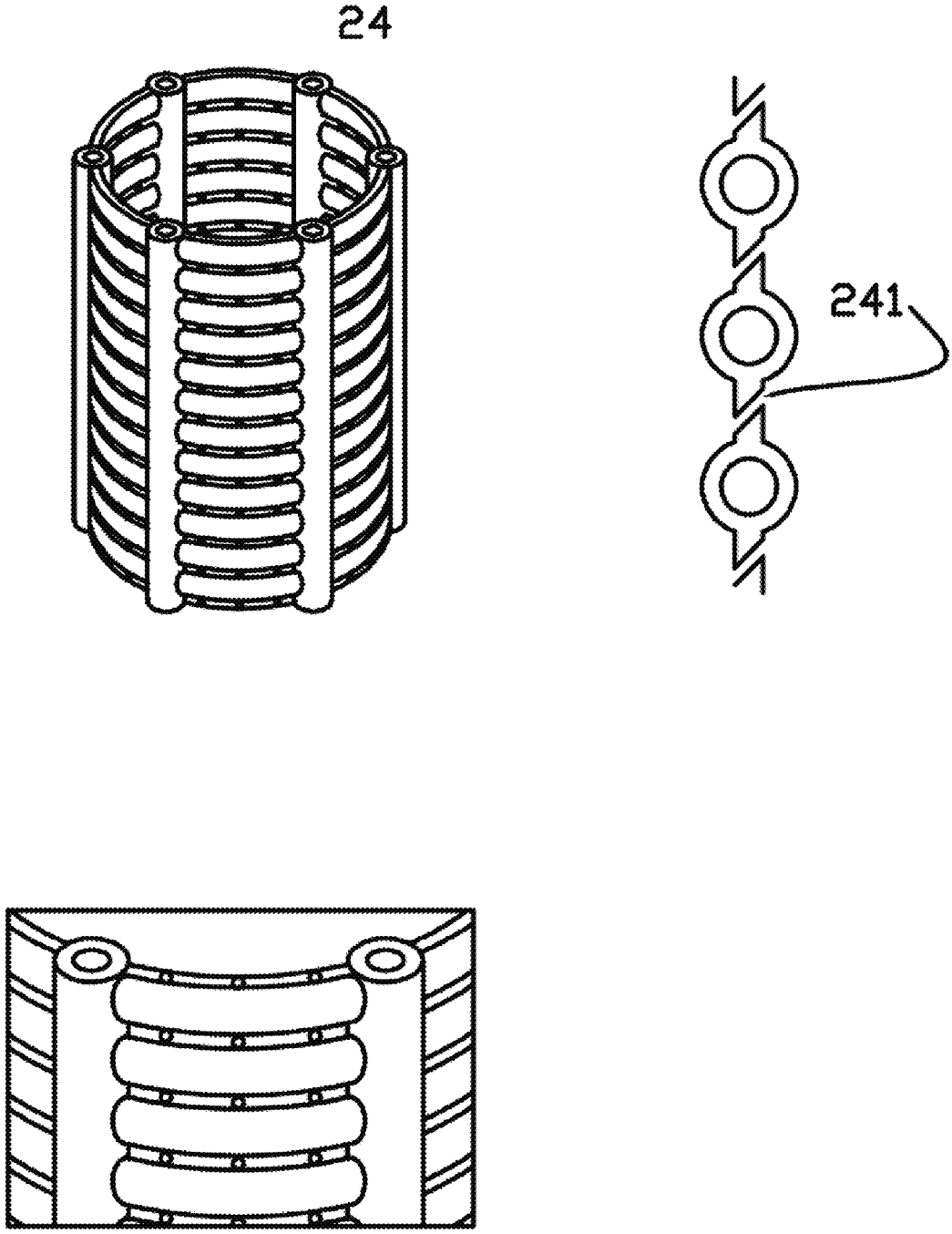
FIG. 4 are sectional views illustrating a horizontal arrangement of inner water walls.
Figure 5:
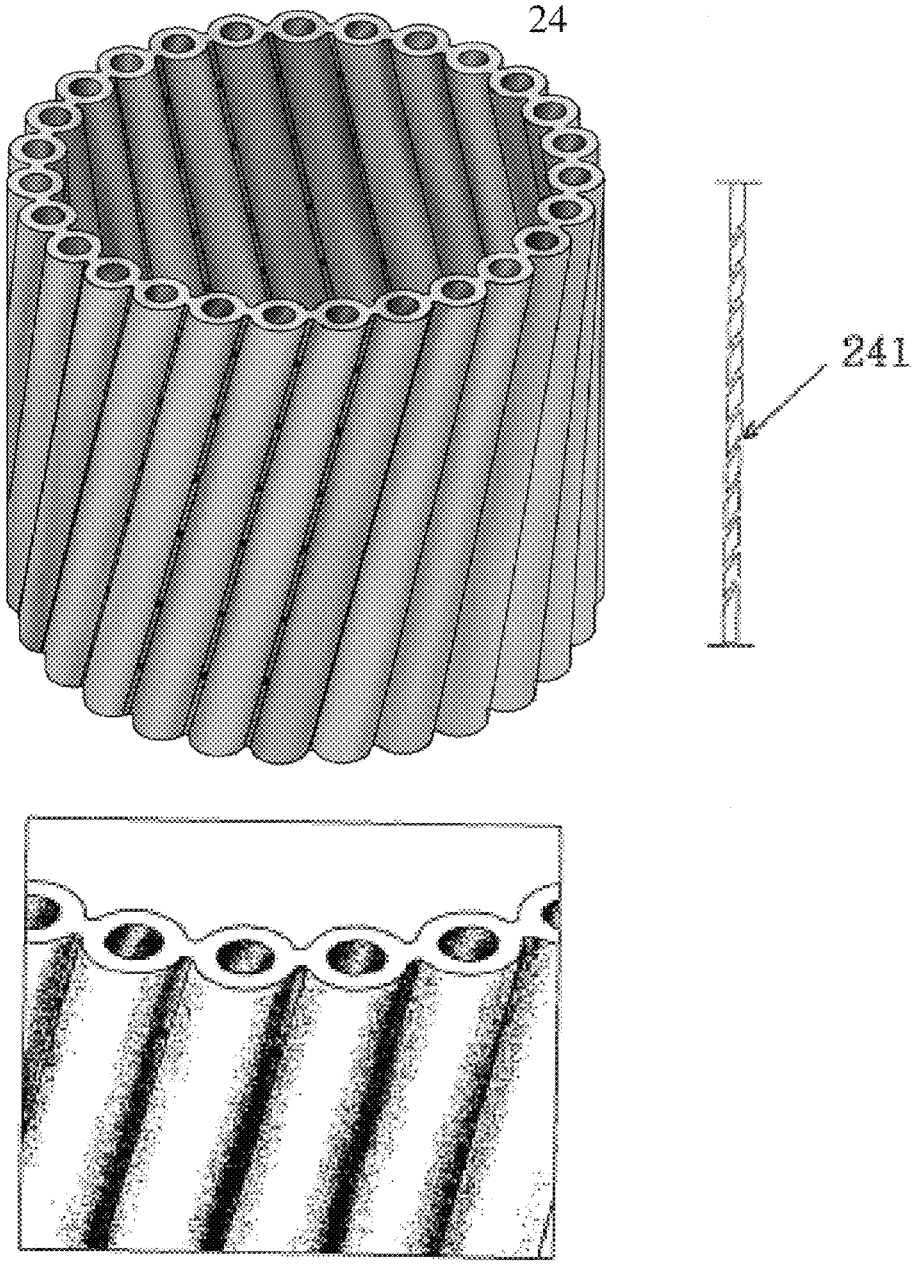
FIG. 5 are sectional views of a helical arrangement of the inner water walls.
Figure 6:
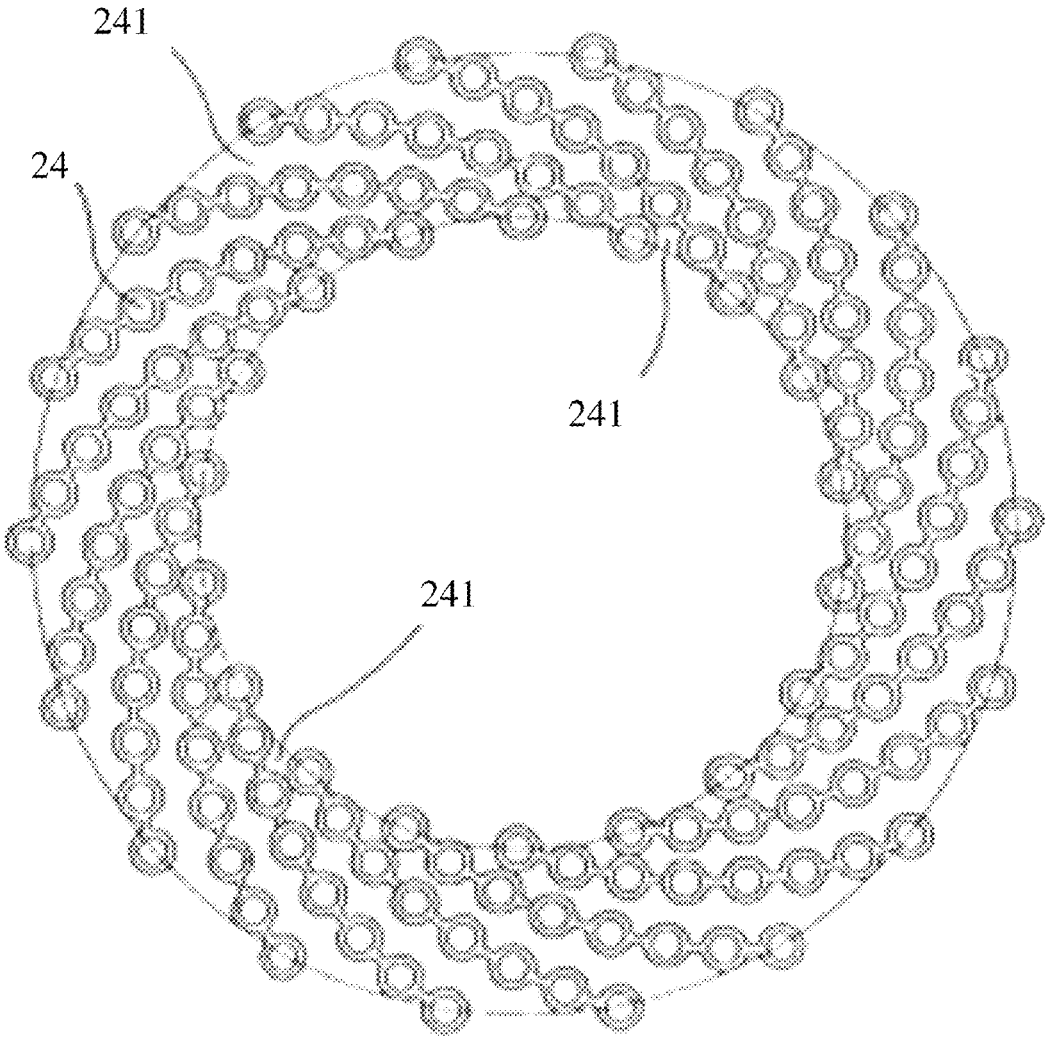
FIG. 6 is a cross-sectional top view illustrating centrifugal arrangement of inner water walls.
Figure 7:
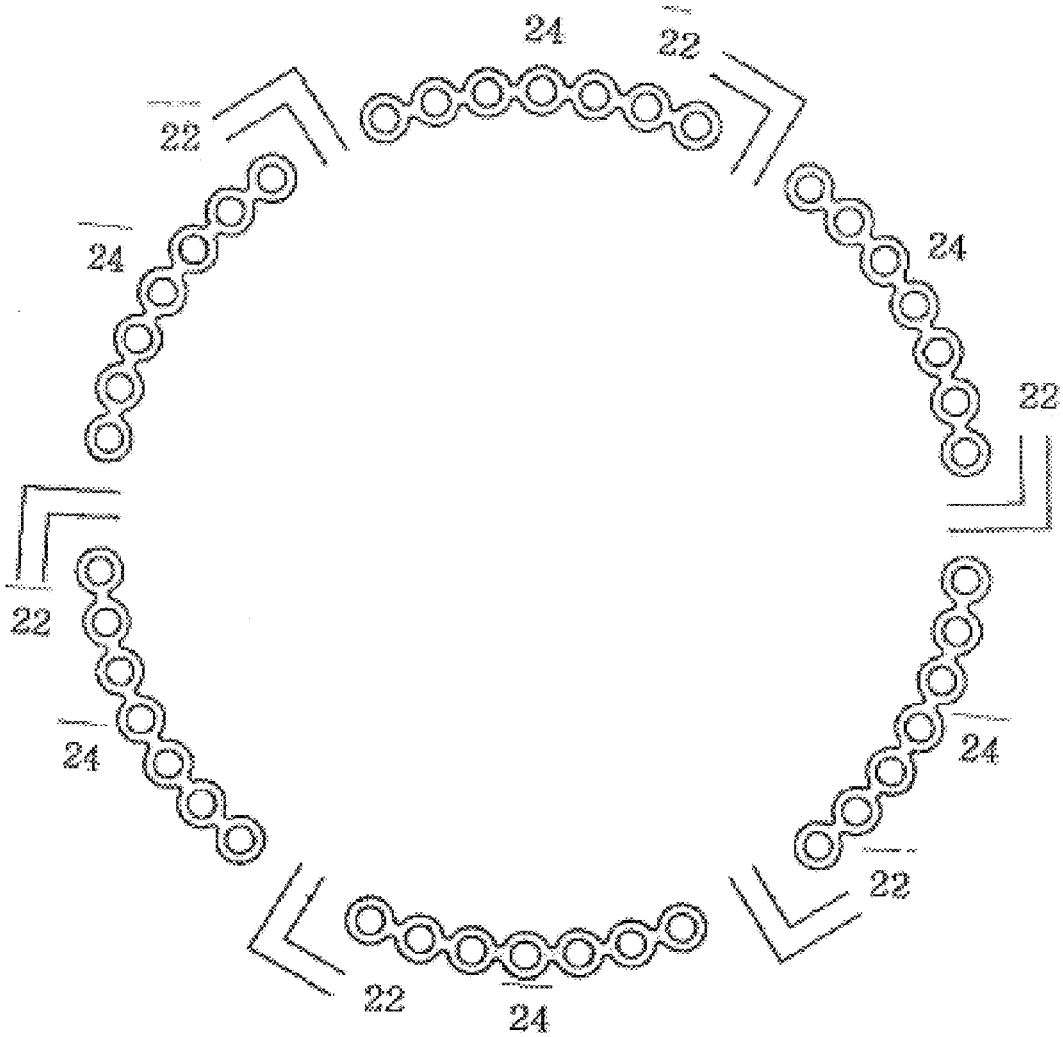
FIG. 7 is a cross-sectional top view illustrating a vertical, intermittent arrangement of inner water walls.

The structure of the water walls for flame reflection can vary depending on the particular configuration, such as, vertical (FIG. 3), horizontal (FIG. 4), helical (FIG. 5), vertical/centrifugal (FIG. 6), vertical/intermittent (FIG. 7), etc. Members of the connecting structure of each water tube have air injecting holes (241) with a helical arrangement. Configuration of air injection holes (241) can vary such as circular, rectangular or an intermittent type between the water walls. Surfaces of water tubes of the water walls (24) are coated by erosion resistant materials and are protected from high temperature erosion by combusted particles mixed with the flame which have high speed impinging energy. Therefore, the space between the outer water walls and the inner water walls becomes a combustion chamber and makes a fire tunnel such that the heat transfer rate is increased due to the wider conducting surfaces within a shorter distance.

Figure 8:
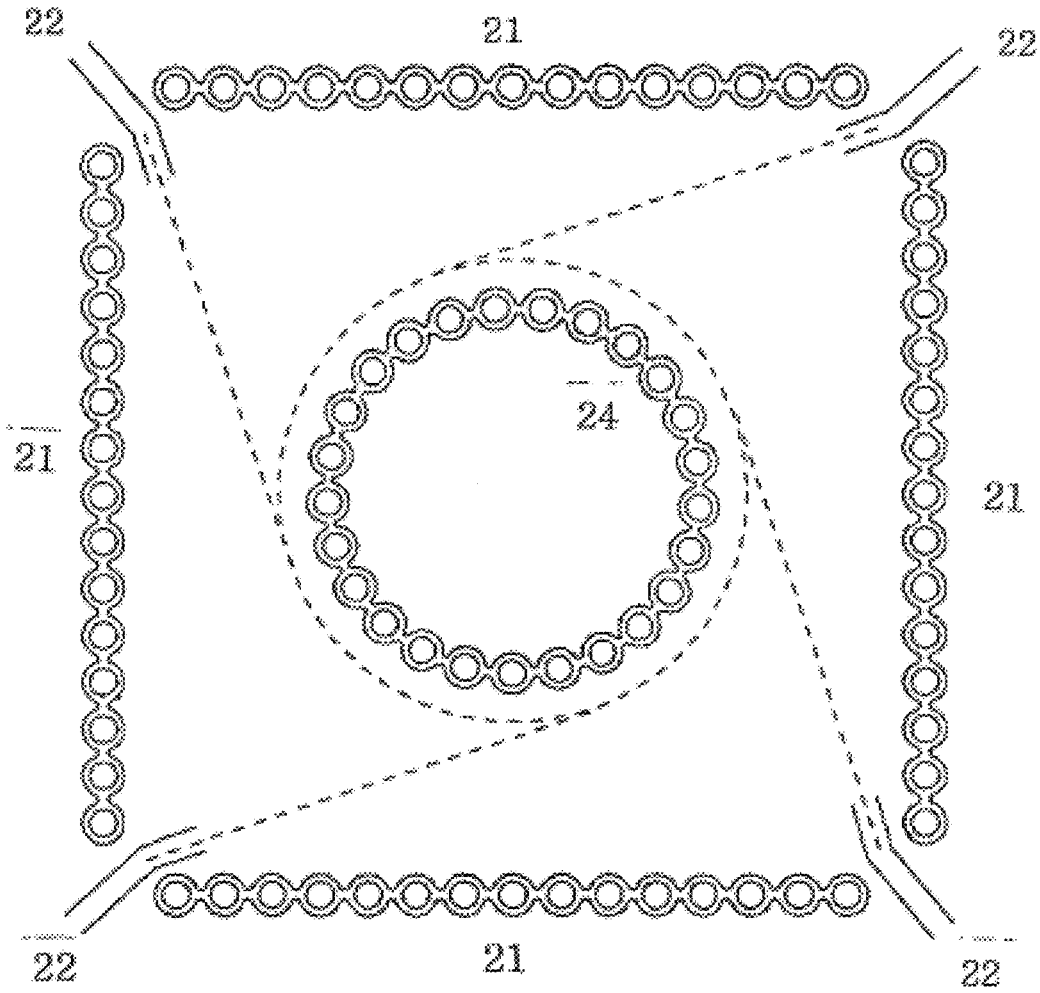
FIG. 8 is a cross-sectional top view of a rectangular boiler.
Figure 9:
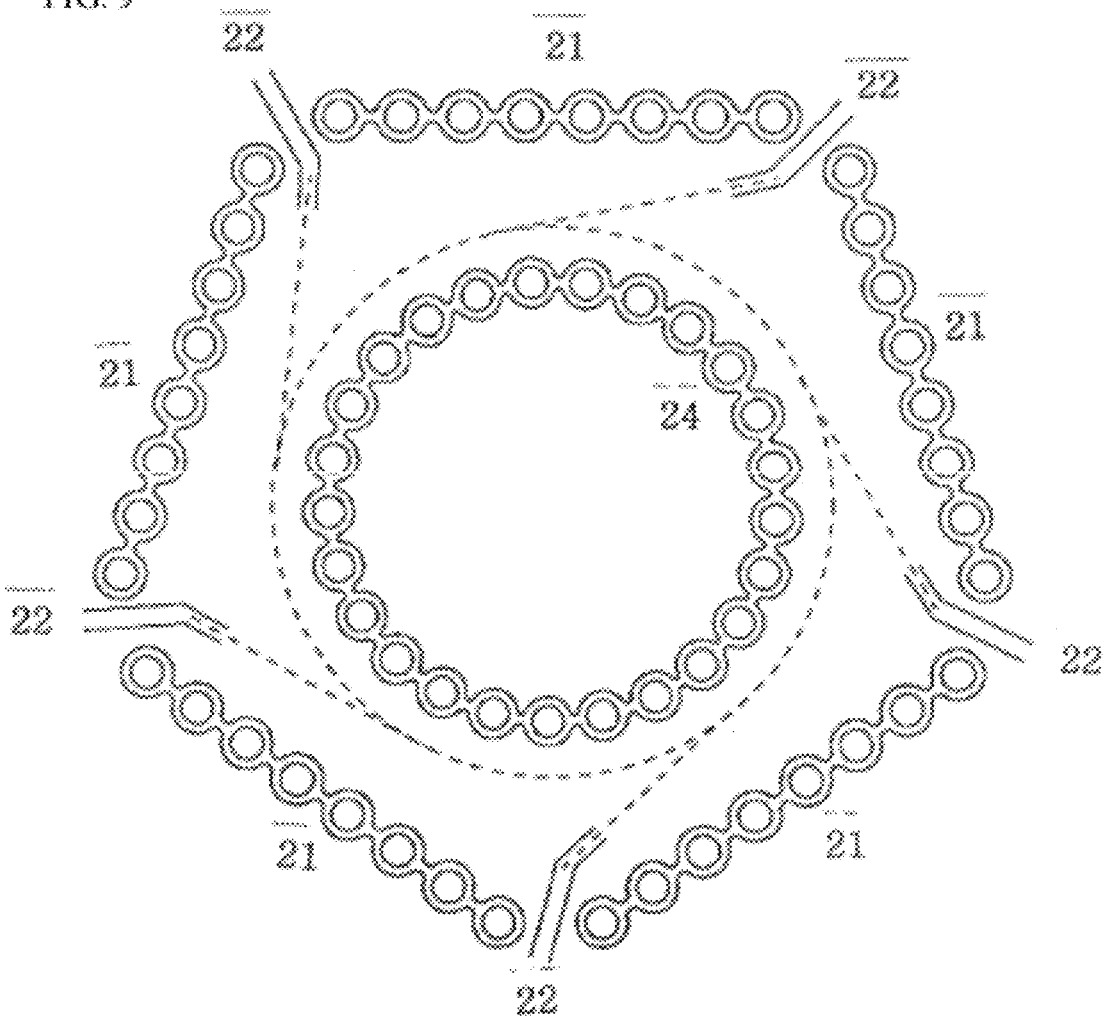
FIG. 9 is cross-sectional top view of a polygon-shaped boiler.
Figure 10:
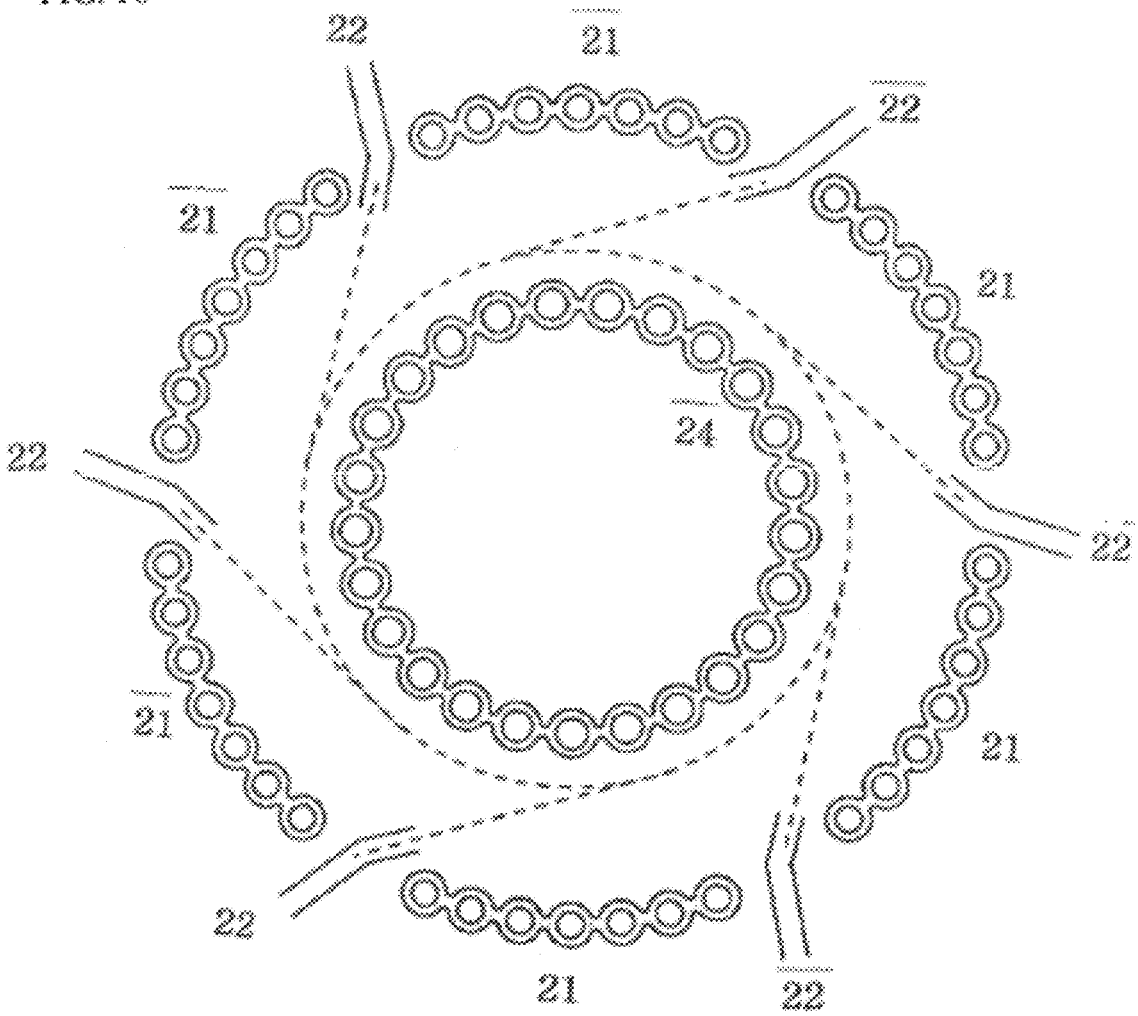
FIG. 10 is a cross-sectional top view for circular-shaped boiler.

An example of the operation of the present invention is explained as follows. The water tubes are filled with water and the inside of the furnace is heated by igniting oil sprayed from the burner or plasma burner. Pulverized coal is sprayed onto the flame through eddy injection nozzle tips (22). Once the coal-fired flame ignites, the burner is shut off. As the coal-fired flame grows, auxiliary air come out of the inner water walls (24) in a helical pattern. The auxiliary air moving upward in a helical pattern from the inner water walls (24) causes the flame from the eddy fuel-air nozzle tip (22) to rotate around the inner water walls and become a fire tunnel between two walls, heating the surface of both water walls and increases the heat transferring effect. Thus, the rapid temperature rise of the water result in more steam evaporation. Here, if the outer water walls are have a polygon shape (FIG. 5), rather than rectangular (FIG. 8) or circular (FIG. 10), the flame becomes fire tunnel more easily and becomes more efficient.

In another embodiment, the inner walls have a refractory structure which reflects the flame instead of inner water walls. This arrangement also increases the flame density and provides shorter heating distance and result in efficiency rising of boiler.

In still another embodiment, the inner walls have a grid structure which reflects the flame instead of inner water walls. The grid in this arrangement radiates heat and increases boiler efficiency.

The boiler furnace has been described through specific embodiments, but should not be confined or limited to these examples. A person with ordinary knowledge in the field to which the present invention belongs can use the technical concepts to modify the present invention. Thus, the present invention includes the scope of the following claims and its equivalents.

Figure 13:
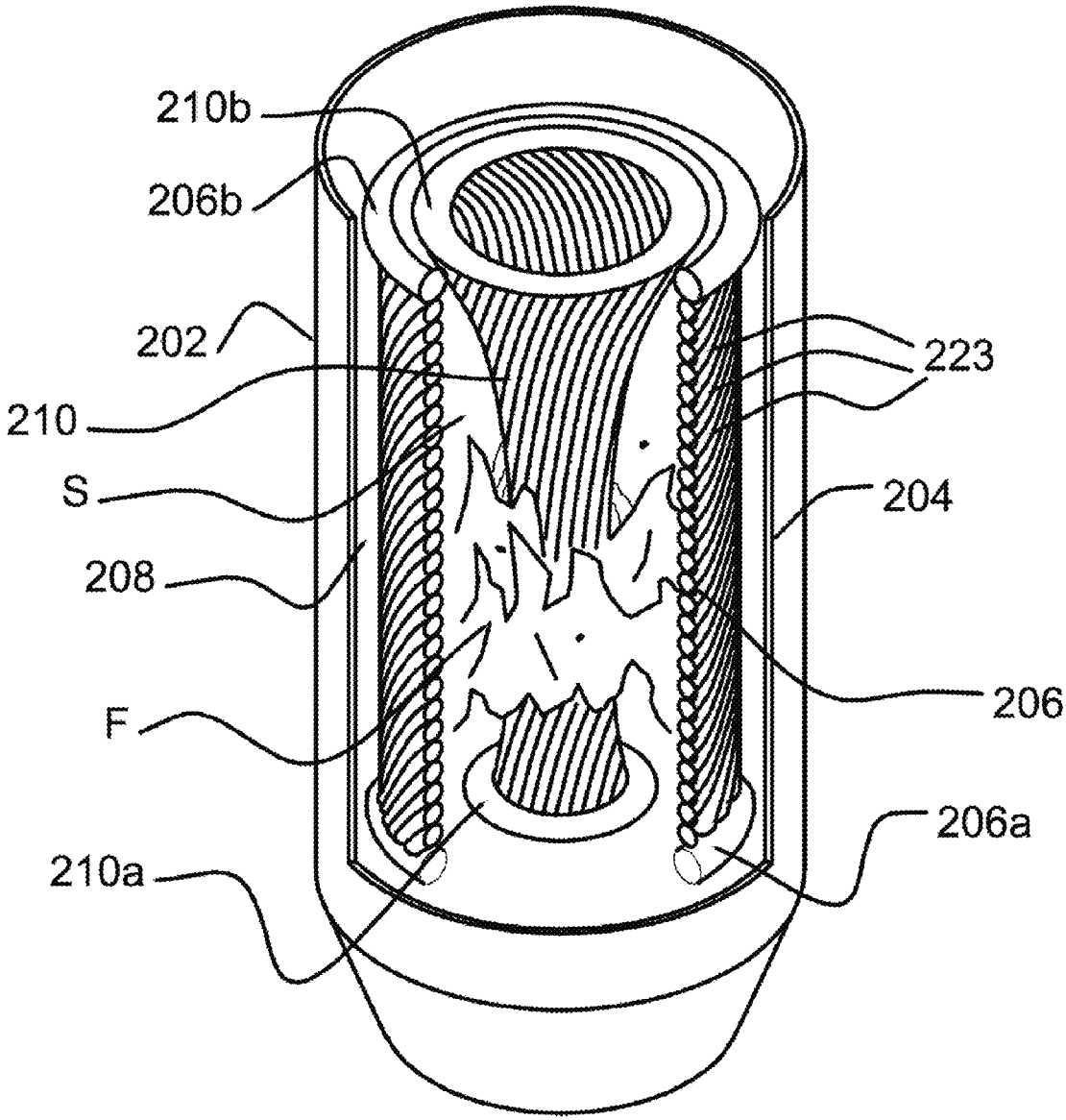
FIG. 13 is a cut-away view illustrating another embodiment of a boiler furnace.

FIG. 13 shows another embodiment of the boiler furnace 202. The boiler furnace includes an outer water wall 206 and an inner water wall 210, with a combustion space S between the inner and outer water walls 210, 206. The outer water wall 206 is composed of a number of water tubes 223 and membranes which connect and seal water tubes in parallel and which are fed by water headers 206*a*, 206*b*. The outer water wall 206 defines an outer boundary of the combustion space S and the inner water wall defines an inner boundary of the combustion space S. The volume defined inside the inner water wall is a non-combustion space that supplies air to the combustion space via air holes or gaps between water tubes in the inner water wall 210. The outer water wall 206 is adjacent to a thermal insulator 208, which is positioned between the outer water wall 106 and the furnace wall 204. An annular or ring-like flame F is produced in the combustion space S around the curved inner water wall. The boiler furnace shown in FIG. 13 is an embodiment that uses a curved inner water wall 210 and has features explained in paragraphs [004] to [013 ] but may also utilize other features of the invention that are described above with respect to FIGS. 2-12.

The inner water wall 110 also includes water tubes and membranes which connect and seal water tubes in parallel.

Water flows into the outer and inner water walls 106, 110 through respective water supplying headers 106*a*, 110*a* at the bottom of the outer and inner water walls 106, 110.

The outer water wall 106 may slope inward so that the top of the outer water wall 106 has a smaller diameter. The cross sectional shape of the outer water wall 106 can vary according to the shape of the combustion room 102.

In the example shown in FIG. 13, the inner water wall 110 has a trumpet-like shape that flares out at the bottom and the top with a smaller diameter in the middle of the inner water wall 110. This configuration provides a wider combustion space S near the middle of the furnace. The combustion space S near the top is narrower so that there is more heat generation toward the middle and top and more convective heat is transferred to the middle and top portions of the outer and inner water wall 106, 110.

Fuel injection nozzles (not shown) are arranged in intervals on the outer water wall 106. The fuel injection nozzles are aimed in a tangential direction toward the inner water wall.

The narrow diameter of the middle of the inner water wall 110 provides a ring-like or annular flame profile which is a stable and controllable flame. The contours of the flame or fireball can be adjusted for increased stability, heat or efficiency by further variations in the fuel and air mixtures.

What is claimed is:

1. A boiler furnace, comprising:
an outer water wall; and
an inner water wall positioned inside the outer water wall to define
a combustion space between the outer water wall and the inner water wall, and
a non-combustion air space inside the inner water wall;
wherein the inner water wall comprises a circular cross section with a middle portion having a narrower diameter and top portions having a wider diameter.

2. The boiler furnace of claim 1, wherein the outer water wall comprises a circular shape.

3. The boiler furnace of claim 1, wherein the outer water wall comprises a first set of water pipes.

4. The boiler furnace of claim 3, wherein the first set of water pipes comprise a helical arrangement.

5. The boiler furnace of claim 1, wherein the inner water wall comprises a second set of water pipes.

6. The boiler furnace of claim 5, wherein the second set of water pipes comprise a helical arrangement.

7. The boiler furnace of claim 5, wherein the second set of water pipes are configured to define air gaps between each of the water pipes.

8. The boiler furnace of claim 1, wherein the inner water wall defines a trumpet-like shape.

9. The boiler furnace of claim 1, wherein the inner water wall and the outer water wall are configured in a coaxial arrangement.

10. The boiler furnace of claim 1, further comprising:
a plurality of fuel nozzles on the outer water wall.

11. The boiler furnace of claim 10, wherein the fuel nozzles are positioned to provide a fuel spray pattern tangential to surfaces of the inner water wall.

12. The boiler furnace of claim 1, further comprising:
a furnace wall positioned around the outer water wall; and
a thermal insulator positioned between the furnace wall and the outer water wall.

13. The boiler furnace of claim 1, further comprising:
an inner water supply header at a bottom of the inner water wall; and
an inner steam receiving header at a top of the inner water wall.

14. The boiler furnace of claim 1, further comprising:
an outer water supply header at a bottom of the outer water wall; and
an outer steam receiving header at a top of the outer water wall.

15. The boiler furnace of claim 1, wherein:
the bottom portion of the inner water wall has a wider diameter than a middle portion of the inner water wall.

16. The boiler furnace of claim 1, wherein:
the bottom portion of the inner water wall has the same diameter as the middle portion of the inner water wall.

17. A boiler furnace, comprising:
an outer water wall with a plurality of fuel nozzles to spray fuel;
a curved inner water wall positioned inside the outer water wall to define a combustion space between the outer water wall and the inner water wall;
a furnace wall surrounding the outer water wall; and
a thermal insulator positioned between the furnace wall and the outer water wall;
wherein fuel ignited in the combustion space produces an annular flame around the curved inner water wall.

18. A method of operating a boiler furnace that includes a curved inner water wall with flared top and bottom portions surrounded by an outer water wall to define a combustion chamber between the inner and outer water walls, the method comprising:
spraying fuel from the outer wall into the combustion chamber;
injecting an airflow through the inner wall into the combustion chamber;
igniting the air-fuel mixture in the combustion chamber to cause a flame in an annular or ring-like shape around the curved inner water wall and surrounded by the outer water wall.

* * * * *